United States Patent [19]

Schlapman

[11] 4,367,603

[45] Jan. 11, 1983

[54] SNOW CASTER HAVING RING GEAR AND SPUR GEAR DRIVE MEANS

[75] Inventor: William J. Schlapman, Winneconne, Wis.

[73] Assignee: J. I. Case Company, Racine, Wis.

[21] Appl. No.: 305,981

[22] Filed: Sep. 28, 1981

[51] Int. Cl.[3] ..... E01H 5/09

[52] U.S. Cl. ..... 37/251; 37/248

[58] Field of Search ..... 37/248, 249, 251, 252, 37/263, 97, 190, 80 A, DIG. 16

[56] References Cited

U.S. PATENT DOCUMENTS

| | | | |
|---|---|---|---|
| 1,389,727 | 9/1921 | Yieter | 37/249 |
| 2,762,137 | 9/1956 | Wells | 37/97 |
| 2,984,025 | 5/1961 | Winn | 37/97 |

FOREIGN PATENT DOCUMENTS

| | | | |
|---|---|---|---|
| 627518 | 7/1961 | Canada | 37/252 |
| 623916 | 8/1978 | U.S.S.R. | 37/249 |

*Primary Examiner*—Edgar S. Burr
*Assistant Examiner*—David A. Wiecking
*Attorney, Agent, or Firm*—Dressler, Goldsmith, Shore, Sutker & Milnamow, Ltd.

[57] ABSTRACT

A snow caster for use as a snow blower is disclosed having auger units which rotate and propel snow toward a fan rotating at a higher speed to propel the snow from the snow caster. The fan is fixed on a drive shaft which extends within the auger units and is operably connected to the auger units by a speed reduction means. The positions of the auger units are maintained by idler rollers included with the speed reduction means.

10 Claims, 6 Drawing Figures

SNOW CASTER HAVING RING GEAR AND SPUR GEAR DRIVE MEANS

TECHNICAL FIELD

This invention relates to snow casters for use on snow blowers and in particular snow casters used on snow blowers to remove snow from sidewalks, driveways and the like.

BACKGROUND OF THE INVENTION

Snow blowers have been used for years by home owners and others to remove snow from driveways, sidewalks and areas around their homes. Generally a snow blower consists of a snow caster having blades which move the snow and a drive unit including wheels and a power source such as an engine, to power the snow caster. The drive unit may be a wheeled cart or a lawn or garden tractor.

A snow caster generally has an auger to drive snow toward a fan unit that propels the snow up a chute and to one side of the snow caster. Snow casters come in two forms, single stage snow casters and a two stage snow casters. In the single stage snow caster, the fan unit is usually integral with the auger blades. However, single stage snow casters have a particular disadvantage. Because the fan unit and auger blades are mounted on the same drive shaft, they rotate together at the same speed. When penetrating deep snow, the auger blades move more snow toward the fan unit than it is capable of propelling through the chute at any given time. This reduces the efficiency of the single stage snow caster and limits the speed of snow clearing as well as the distance that the snow is thrown from the chute.

The two stage snow caster was developed to solve these deficiencies in the single stage snow caster. In this arrangement the fan unit or second stage is separately powered at a higher rotational speed. By rotating at a higher speed the fan unit is able to keep up with the snow moved by the auger, even in deep snow. Because it is separately powered by another drive arrangement, the fan unit is mounted behind and transversely with respect to the auger.

However, the two stage snow caster has its own deficiencies. The transversely mounted second stage makes the snow caster assembly longer from front to back and the snow caster must be mounted further in front of a garden or lawn tractor. This mounting moves the center of gravity of the tractor much further forward reducing the traction of the tractor rear wheels. This is particularly detrimental with small lawn and garden tractors.

In a two stage snow caster, the snow is first moved longitudinally by the auger blades, then transversely into the second stage and finally vertically out of the snow caster. This is opposed to the single stage arrangement of moving longitudinally and then vertically. This multitude of direction changes effects the efficiency of the two stage snow caster and is particularly a problem when items such as sticks are accidentally encountered by the snow caster and become lodged somewhere in the second stage. Because the second stge is mounted behind the augers, it is difficult to remove sticks and similar objects. With both types of snow casters it is important to provide effective support for the augers.

Accordingly, it is desirable to produce a snow caster having the size and operation benefits of a single stage snow caster while maintaining the operational efficiency of a two stage snow caster. Such a snow caster should also provide effective support for the augers. The snow caster of the present invention meets these desires.

SUMMARY OF THE INVENTION

The present invention is a snow caster which can be mounted on the front of a lawn or garden tractor to operate as a snow blower. Alternatively, the snow caster may be mounted on a wheeled cart having an engine to perform as a hand-pushed snow blower.

The snow caster of the present invention has an elongated housing with an opening along the front into which a material such as snow enters as the snow caster is moved forward. A fan fixed on a drive shaft rotates within the housing to propel snow through a discharge spout positioned on the back of the housing. An auger unit having an auger blade fixed on an auger tube also rotates in the housing with the drive shaft extending into the auger tube. The auger unit propels the snow toward the fan as it is rotated.

The fan is preferably mounted on the center of the shaft and two auger units are mounted opposite each other with respect to the fan to propel the snow from either side toward the fan. A speed reduction means operably interconnects the drive shaft and the auger unit such that the auger unit rotates at a slower speed with respect to the drive shaft and fan.

The speed reduction means includes an internal spur gear fixed on the drive shaft engaging a ring gear mounted coaxially on the auger unit. At least one, preferably adjustable, idler roller is rotatably mounted on the housing to coact with the inside of the auger tube to maintain the gears in mesh. Adjustment of this roller permits the proper alignment of the auger unit.

Because the fan rotates at a faster speed, about twice as fast as the auger unit, it is able to keep up even in deep snow. The benefits of a two stage unit are gained without having to mount the fan behind the auger unit. Thus the detriments of a second stage are avoided. Not only are there the size benefits of a single stage snow caster, but the present invention can even utilize a single stage snow caster housing, thus cutting production costs. In short, the present invention has gained the benefits of both previous types of snow casters without their respective detriments.

Numerous other advantages and features of the present invention will become readily apparent from the following detailed description of the invention, the accompanying examples, and the appended claims.

BRIEF DECRIPTION OF THE DRAWINGS

DETAILED DESCRIPTION OF THE INVENTION

Figure 1:
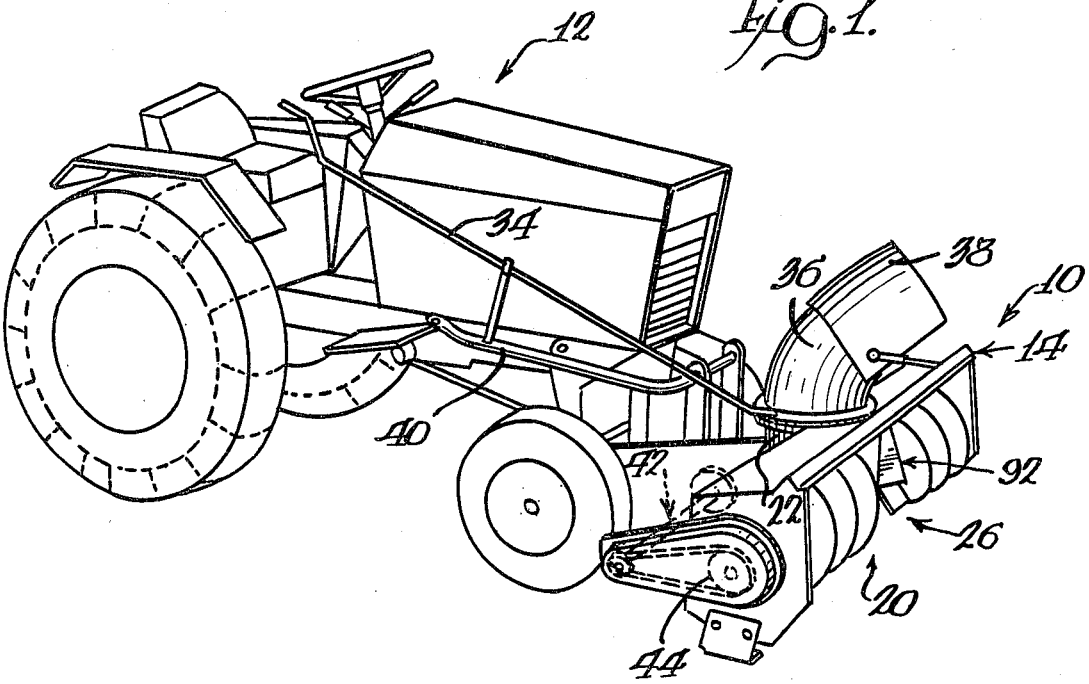
FIG. 1 is a perspective view showing the snow caster of the present invention mounted on the front of a tractor.

While this invention is susceptible of embodiment in many different forms, there is shown in the drawings and will be described in detail, preferred embodiments of the invention. It should be understood, however, that the present disclosures be considered as an exemplification of the principles of the invention and is not intended to limit the invention to the embodiments illustrated.

The precise shapes and sizes of the components described are not essential to the invention unless otherwise indicated. For ease of description, the snow caster of this invention will be described in a normal operating position and such terms as front, back, top, bottom, etc. will be used in reference to this position. The snow caster of this invention has certain conventional drive mechanisms, the details of which, though not fully illustrated or described, will be apparent to those having skill in the art and an understanding of the necessary functions of such mechanisms.

Figure 2:
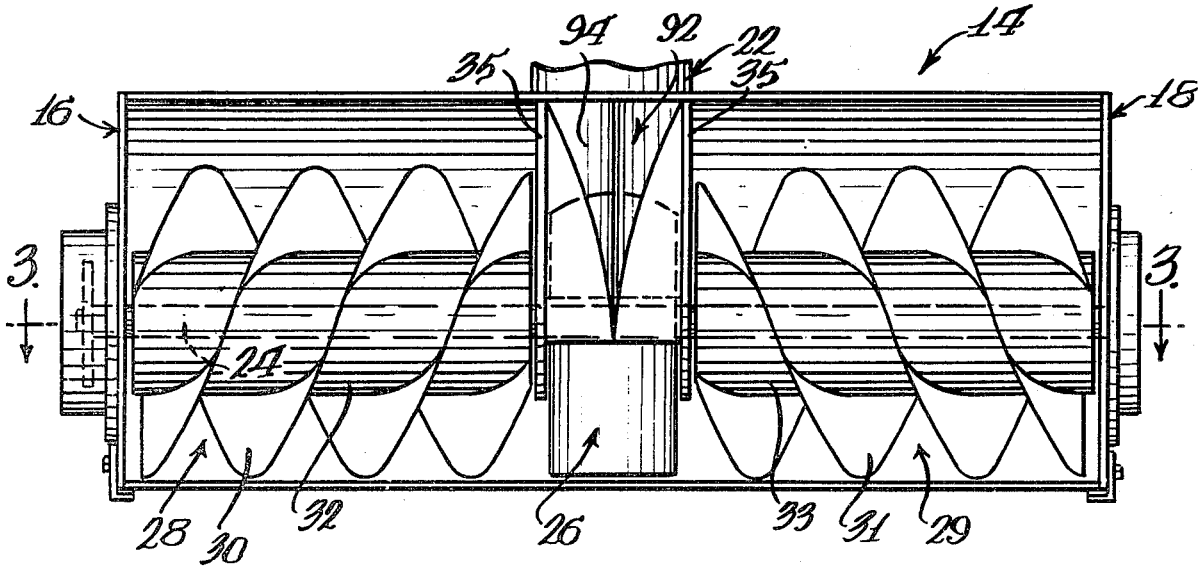
FIG. 2 is an enlarged, fragmentary front elevational view of the snow caster showing auger units and a fan.

A snow caster 10 of the present invention is shown in FIG. 1 mounted on the front of a garden tractor 12. Referring also to FIG. 2, the snow caster generally includes an elongated housing 14 having ends 16 and 18 and an opening extending substantially between the ends defining the front 20 of the housing into which snow is received as the snow caster is moved forward. The housing 14 is also provided with a discharge spout 22 positioned rearwardly of the front and preferably in the central portion of the housing.

A drive shaft 24 is rotatably mounted transversely within the housing 14 and preferably extends substantially between the ends 16 and 18 of the housing. A fan 26 is mounted on the drive shaft 24 adjacent the discharge spout 22 to propel the material such As snow through the discharge spout. An auger unit 28 having an auger blade 30 fixed on an auger tube 32 is rotatably mounted within the housing 14 with the drive shaft 24 extending into the auger tube. Preferably, two auger units 28 and 29 are mounted opposite each other with respect to the fan to propel snow toward the fan 26 from both sides. The second auger unit 29 also has an auger blade 31 mounted on an auger tube 33. The auger units 28 and 29 are preferably provided with two sets of auger blades making up two flights. This increases the volume of snow which is propelled by each auger unit.

A speed reduction means operably interconnects the drive shaft 24 and the auger units 28 and 29 such that the auger units are rotatable at a slower speed with respect to the drive shaft. The operation and embodiments of this speed reduction means will be described in more detail later.

One of the advantages of locating the drive shaft 24 within the auger tube 32 and 33 is that the drive shaft and the speed reducing means are protected from the snow and possible corrosion. This also reduces the total amount of area necessary for mounting the drive for the fan 26 and the auger units 28 and 29.

Although the drive shaft 24 is shown extending completely through the auger tubes 32 and 33, it is understood that it need not be so fully extended and need only extend partially into an auger tube to provide drive for the speed reducing means. Preferably a support 35 is mounted on and included with the housing 14 and extends into the housing to rotatably support the drive shaft 24 adjacent the fan 26 (see also FIG. 5).

Referring again to FIG. 1, the operation of the snow caster can easily be controlled by an operator sitting on the tractor 12. A chute crank 34 adjusts the direction of the chute 36 and deflector 38 to aim the propelled snow out of the path being cleared. Deflector 38 sets the elevation of the propelled stream of snow controlling the distance it is thrown. A lift arm 40 is used to raise the snow caster to avoid any obstacles in the path. Power to the snow caster is provided by the tractor through a pulley arrangement to a jack shift 42 and a chain drive mechanism 44.

Figure 3:
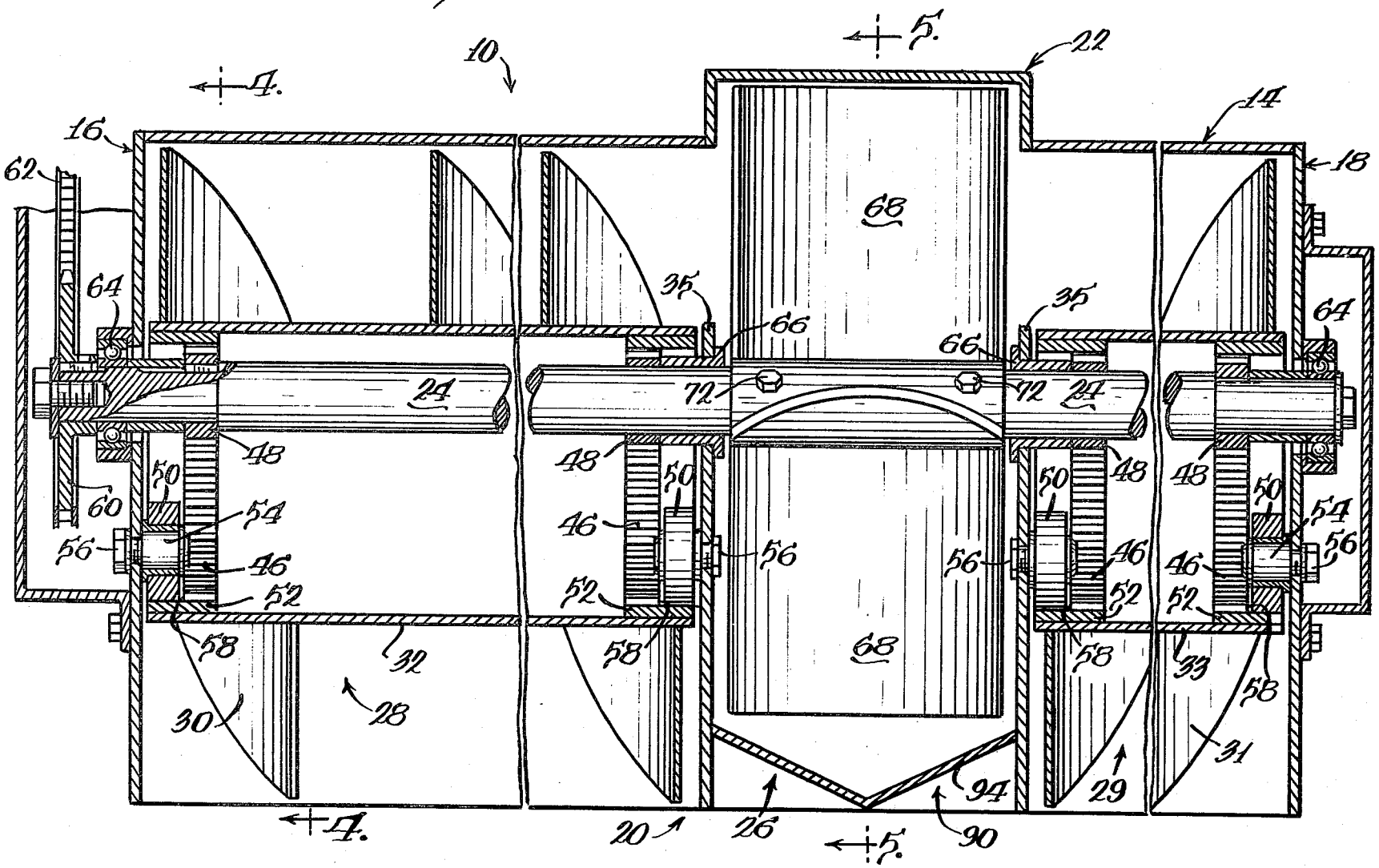
FIG. 3 is an enlarged, fragmentary top plan view showing a speed reduction means including an idler roller and a pinion and ring gear system.
Figure 4:
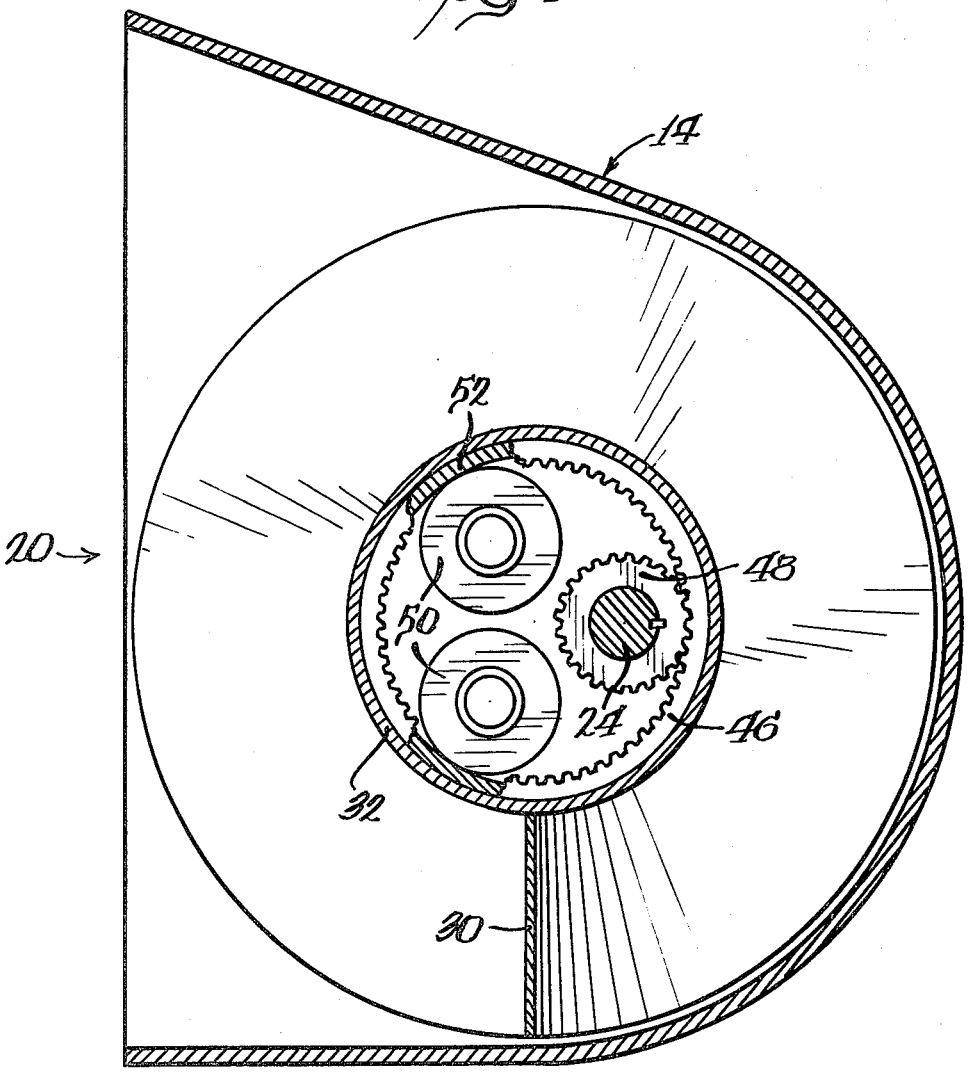
FIG. 4 is a cross-sectional view taken generally along plane 4—4 of FIG. 3 showing the speed reduction means.

The preferred embodiment of the speed reduction means can be seen in FIGS. 3 and 4. The speed reduction means includes a ring gear 46 mounted coaxial on the auger tube and engaged with a spur gear 48 mounted on the drive shaft 24. At least one, preferably two, idler rollers 50 are rotatably mounted on the housing 14 adjacent the ring gear 46 to coact with the inside of respective auger tubes 32 and 33 to align the auger units 28 and 29 and maintain the ring and spur gears in mesh. The idler rollers 50 may coact directly with the auger tubes 32 and 33 or may coact with annular members 52 mounted within the tubes. Preferably, the ring gears 46 are also mounted on annular members 52. This helps to maintain the circular alignment of gears and rollers.

The idler rollers 50 are preferably rotatably mounted on roller shafts 54 which are adjustably mounted on the housing 14 by mounting bolts 56. This permits minor adjustment of radial location with respect to the auger tubes 32 and 33. Thus, if through use or wear the spur 48 and ring gear 46 are no longer in proper mesh the mounting bolt 56 may be loosened and move radially from the center of the auger tube to reestablish proper mesh. The idler rollers 50 also provide end alignment for the auger units 28 and 29 by coating with end thrust bearing surfaces 58 on the ring gears 46.

Preferably, a drive coupling means such as sprocket 60 is mounted on the drive shaft 24 to couple the shaft as by chain 62 to a rotational power source. Alternatively, instead of a sprocket, a gear or pulley system may be used. It is also possible to mount the drive coupling means on the auger unit. Bearings 64 are preferably mounted on the ends of the houing to coact with and align the drive shaft 24. Bushings 66 are also mounted on the housing to coact and align the drive shaft 24.

The speed reduction means may be mounted adjacent the ends 16 and 18 of the housing 14, adjacent the fan 26, or as shown in FIG. 3, there may be four speed reduction means mounted adjacent the fan and both ends. This reduces the torque variation along the drive shaft 24.

As can also be seen in FIG. 3, the fan 26 preferably includes a plurality of paddles 68 having an arcuate cross section. The paddles 68 are preferably arcuate or cup-shaped in cross-section to direct the snow toward a more centralized flow pattern and into the center of the discharge spout 22.

Figure 5:
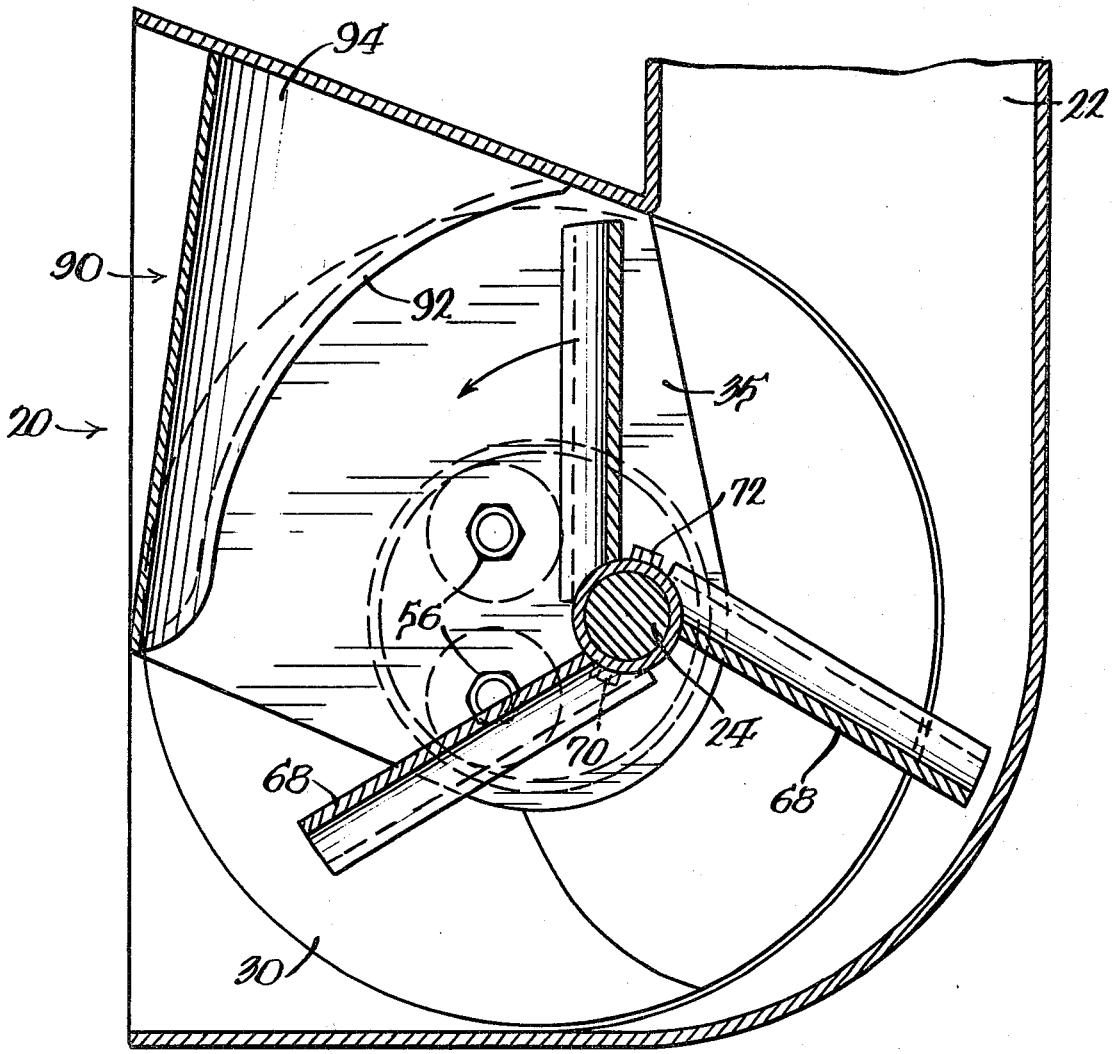
FIG. 5 is a cross-sectional view taken generally along plane 5—5 of FIG. 3 showing the structure of the fan.

The positioning of the fan 26 adjacent the discharge spout 22 can best be seen in FIG. 5. The fan 26 may include four paddles, three paddes as shown, two paddles, or only one paddle. As shown in FIG. 5 the fan 26 has approximately the same diameter as the auger units. The fan 26 and the auger units 28 and 29 should be within about one half of an inch of the back of the housing 14 to prevent snow build up. Preferably, the fan 26 is removably mounted on the drive shaft 24 and retained on the drive shaft by a nut 70 and bolt 72.

Figure 6:
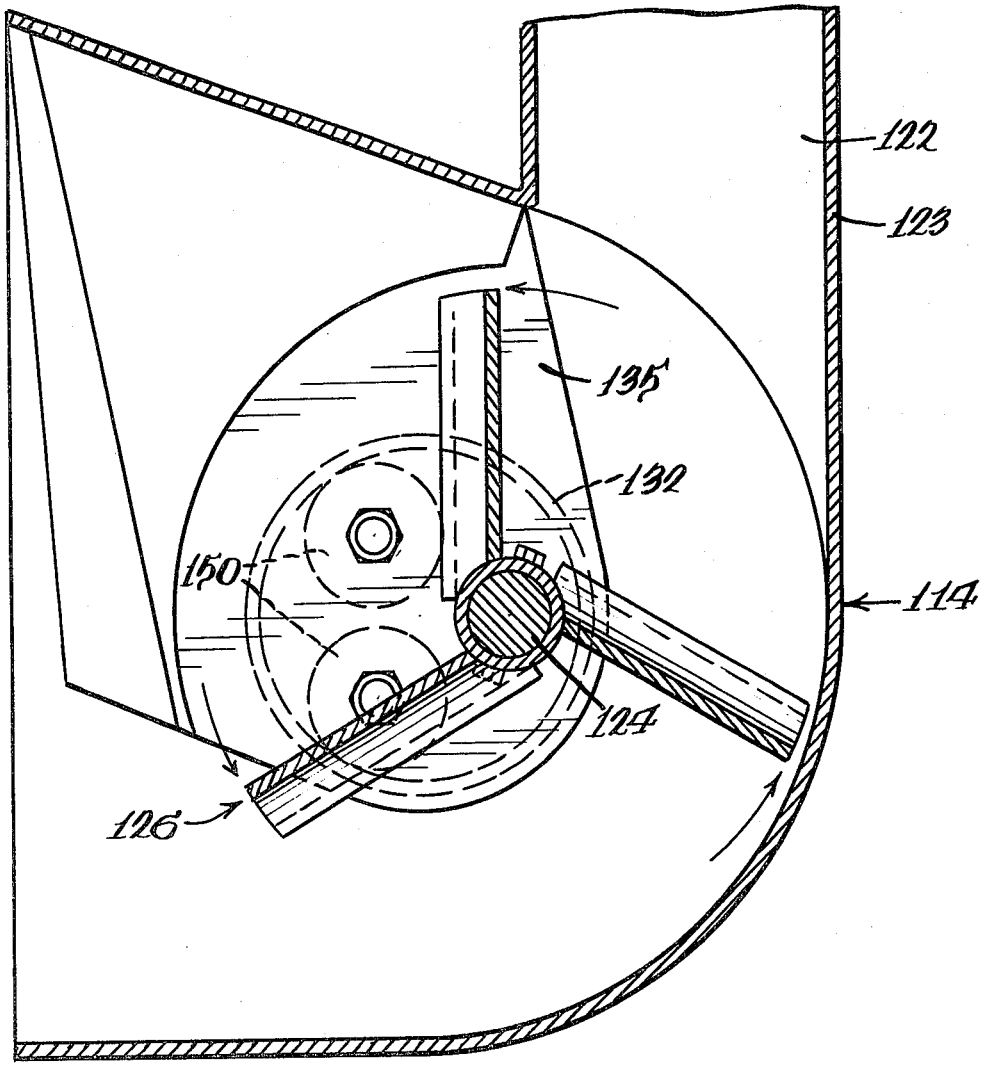
FIG. 6 is a fragmentary, cross-sectional view similar to FIG. 5 showing an alternative embodiment for the fan and housing.

Alternatively as shown in FIG. 6, the fan 126 may have a smaller diameter than the auger units. In this embodiment the fan 126 is mounted eccentrically toward the back side of the side of the housing 114 with respect to the auger tube 132. The diameters of the auger units and fan 126 are substantially tangential adjacent the back side of the housing 114 as shown in FIG. 6. This directs the snow up discharge spout 122 having a rear wall 123 in line with the rear wall of the housing 114. The position of the support 135, drive shaft 124, idler rollers 150, and the ring and spur gears are as before. Thus a single stage snow caster housing may be used for this embodiment. This reduces the necessary stock of ports and the cost of production.

A snow deflector 90 is mounted on the housing 14 to deflect high drifts of snow away from the fan 26 and into the auger units. See FIGS. 1, 2 and 5. The snow deflector 90 includes a curved deflector plate 92 and a generally V-shaped plow member 94 mounted on the convex side of the deflector plate. The plow member 94 deflects the snow into the auger units as the snow caster is pushed through a high drift. The deflector plate 92 is mounted on the housing adjacent the fan 26 to deflect downward material propelled by the fan toward the opening in front 120. As can be seen in FIG. 5, if the fan 26 attempted to propel snow or more importantly a rock forward of the snow caster, it would strike deflector plate 92 and be deflected downward. This not only prevents snow from being propelled forward into the path being cleared, but also protects against the threat of rocks and the like being thrown forward and possibly injuring passersby.

In operation, a rotational power source such as the tractor is connected as by the sprocket 60 to drive shaft 24. The speed reduction means i.e., ring gear 46 and spur gear 48 drive the auger units 28 and 29 at about one-half the speed of the drive shaft 24. As the snow caster is moved forward, snow enters the front 20 of the housing 14 and is propelled by the auger units toward the fan 26. The fan then propels the snow through the discharge spout 22 and out away from the vehicle.

The present system moves the snow directly into the fan and out through the discharge chute. This avoids the two-stage snow blower problem of moving the snow through several different angles before it is discharged. The present system also has the advantage in that the fan turns at a higher rotational velocity than the auger units, thus allowing it to keep up with snow which is propelled into the fan.

The foregoing specification is intended as illustrative and is not to be taken as limiting. Still other variations within the spirit and scope of this invention are possible and will readily present themselves to those skilled in the art.

What is claimed is:

1. A snow caster comprising:

(a) an elongated housing having ends and an opening extending substantially between the ends defining the front of the housing, the housing also having a discharge spout positioned rearwardly of the front;

(b) a drive shaft rotatably mounted transversely within the housing;

(c) a fan mounted on the drive shaft adjacent the discharge spout to propel material such as snow through the discharge spout;

(d) an auger unit including an auger blade mounted on an auger tube, the auger unit rotatably mounted within the housing with the drive shaft extending into the auger tube, the auger unit adapted to propel material such as snow toward the fan as the auger unit is rotated; and (e) speed reduction means for operably interconnecting the drive shaft and the auger unit such that the auger unit rotates at a slower speed with respect to the fan, the speed reduction means including a ring gear mounted coaxially on the auger unit, an internal spur gear mounted on the drive shaft engaging the ring gear, and an idler roller rotatably mounted on the housing to coact with the inside of the auger tube to align the auger unit and maintain the ring and spur gears in mesh.

2. The snow caster of claim 1 wherein the drive shaft extends substantially to the ends of the housing and the fan is mounted centrally on the shaft and the snow caster is provided with two auger units mounted opposite each other with respect to the fan, each auger unit being provided with speed reduction means for operably interconnecting with the drive shaft.

3. The snow caster of claim 2 wherein each speed reduction means is mounted adjacent the ends of the housing.

4. The snow caster of claim 2 wherein each speed reduction means is mounted adjacent the fan.

5. The snow caster of claim 1 wherein the fan includes paddles having an arcuate cross-section mounted on the drive shaft, the diameter of the fan being substantially equal to the diameter of the auger unit.

6. The snow caster of claim 1 including drive coupling means mounted on the shaft for coupling the drive shaft to a rotational power source.

7. The snow caster of claim 1 including a support mounted on the housing and extending into the housing to rotatably support the drive shaft adjacent the fan.

8. A snow caster comprising:

(a) an elongated housing having a front side, a back side, ends and a central portion between the ends, the housing having an opening extending substantially between the ends defining the front of the housing, the housing also having a discharge spout positioned on the central portion of the back side of the housing;

(b) a drive shaft rotatably mounted on the housing extending substantially between the ends of the housing;

(c) A fan mounted on the drive shaft for rotation with the drive shaft adjacent the discharge spout to propel material such as snow through the discharge spout;

(d) two auger units, each auger unit including an auger blade mounted on an auger tube, the auger units rotatably mounted opposite each other with respect to the fan with the drive shaft extending into the auger tubes, with the drive shaft mounted eccentrically toward the back side of the housing with respect to the auger tubes, the auger unit having a diameter greater than the diameter of the fan with their diameters being substantially tangential adjacent the back side of the housing, the auger unit to propel material such as snow toward the fan as the auger unit is rotated; and (e) a ring gear coaxial on each auger unit;

(f) two internal spur gears mounted on the drive shaft engaging respective ring gears; and;

(g) two idler rollers rotatably mounted on the housing to coact with the inside of the respective auger tubes to align the respective auger unit and maintain the ring and spur gears in mesh.

9. The snow caster of claim 8 wherein the housing includes a support to rotatably support the drive shaft adjacent the fan and wherein a ring gear is mounted coaxially on each end of each auger tube and four internal spur gears are mounted on the drive shaft engaging respective ring gears and four idler rollers are rotatably mounted on the housing one at each end of each auger unit to coact with the inside of respective auger tubes to align the respective auger units and maintain the ring and spur gears in mesh.

10. The snow caster of claim 8 wherein the idler rollers are adjustably mounted on the housing.

* * * * *